US005620314A

United States Patent [19]

Worton

[11] Patent Number: 5,620,314

[45] Date of Patent: Apr. 15, 1997

[54] HAND-OPERATED LIQUID PUMP WITH REMOVABLE PARTS

[76] Inventor: David M. Worton, 1570 Hood St., Bloomfield Hills, Mich. 48302

[21] Appl. No.: 391,779

[22] Filed: Feb. 21, 1995

[51] Int. Cl.[6] ..... F04B 53/12; F04B 39/14; F04B 33/00

[52] U.S. Cl. ..... 417/550; 417/555.1; 417/437; 92/162 P

[58] Field of Search ..... 417/437, 550, 417/555.1; 137/512.4; 92/162 P

[56] References Cited

U.S. PATENT DOCUMENTS

| | | | |
|---|---|---|---|
| D. 314,039 | 1/1991 | Manchester et al. . | |
| 695,492 | 3/1902 | Robertson | 417/555.1 |
| 793,523 | 6/1905 | Helsel . | |
| 2,883,939 | 4/1959 | Russell . | |
| 2,915,986 | 12/1959 | Sisson | 417/550 |
| 3,006,282 | 10/1961 | Sisson . | |
| 3,131,646 | 5/1964 | Parrott | 417/550 |
| 3,669,575 | 6/1972 | Beckerer | 417/555.1 |

FOREIGN PATENT DOCUMENTS

| | | | |
|---|---|---|---|
| 607483 | 8/1960 | Italy | 417/550 |
| 1232894 | 5/1971 | United Kingdom . | |

OTHER PUBLICATIONS

Packaging Literature for Han–D–Pump, Copy of Box and technical literature.

Brochure entitled "Chugger" by Chugger Pumps.

Brochure entitled "Industrial Hand Pumps & Accessories" by Beckson Industrial Products.

One–page Advertisement for "The Hog" from Kuranda USA, Annapolis, Maryland, dated Oct., 1993.

*Primary Examiner*—Timothy Thorpe
*Assistant Examiner*—William Wicker
*Attorney, Agent, or Firm*—Harness, Dickey & Pierce, P.L.C.

[57] ABSTRACT

A hand-operated, portable, easily-manufactured liquid pump offering efficiency through advanced plunger design, ease of repairability, and enhanced versatility through use of a select group of inlet and outlet accessories. The pump preferably includes a cylindrical housing, a bottom end forming an inlet port, and a top end with an exhaust port located near the top end. A field-repairable plunger assembly having a plunger which is preferably a rubber diaphragm is located within the cylindrical housing and is connected to a rod and handle for reciprocating the plunger within the housing. A unidirectional flow device is operatively connected to the bottom end of the housing to allow fluids to flow in a direction from the inlet port toward the exhaust port while preventing fluid flow in the opposite direction. The pump may be constructed to allow disassembly from the bottom end or the top end to allow a user to service the pump in the field and to replace worn or failing components. The pump housing and rod volumes are preferably selected to provide efficient ergonomic pumping action on both upstroke and downstroke movement. The plunger mechanism may include an enlarged cup member connected to the rod above the plunger to relieve a significant portion of the pressure applied by the column of liquid in the housing to the plunger during upstroke movement. A variety of plunger and pump rod designs are also discussed.

33 Claims, 5 Drawing Sheets

26
25
24
10
22
21
20
18-3
18
18-2
17
18-1
12
13
14
15
16
34
58
60H
60
62
64
66
68
70
72
72
74
76
27A
28
29
32
16A
31
38
16C
31
30
36
16B
44U
46U
44
44C
42
44L
46L
46
40
16A
28
16C
50
46
32
46
54

FIG - 2
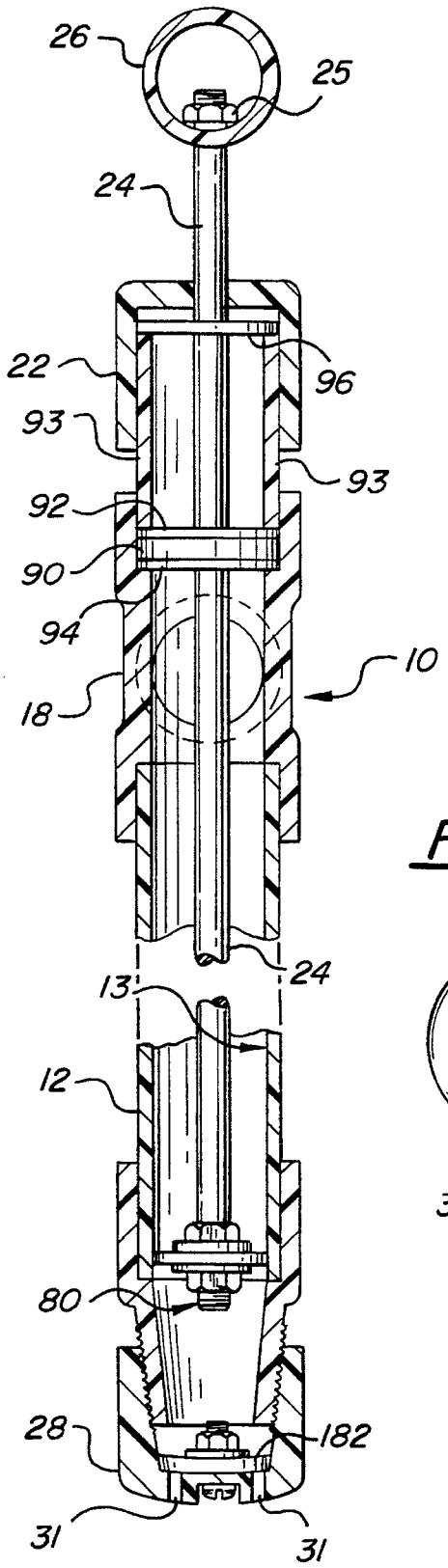
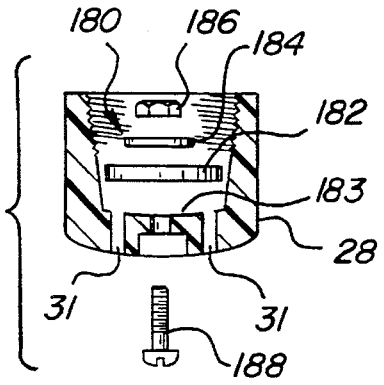
FIG - 4
FIG - 3
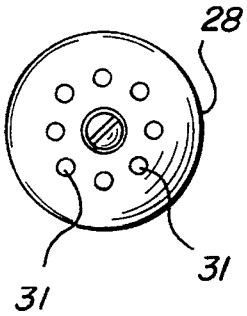
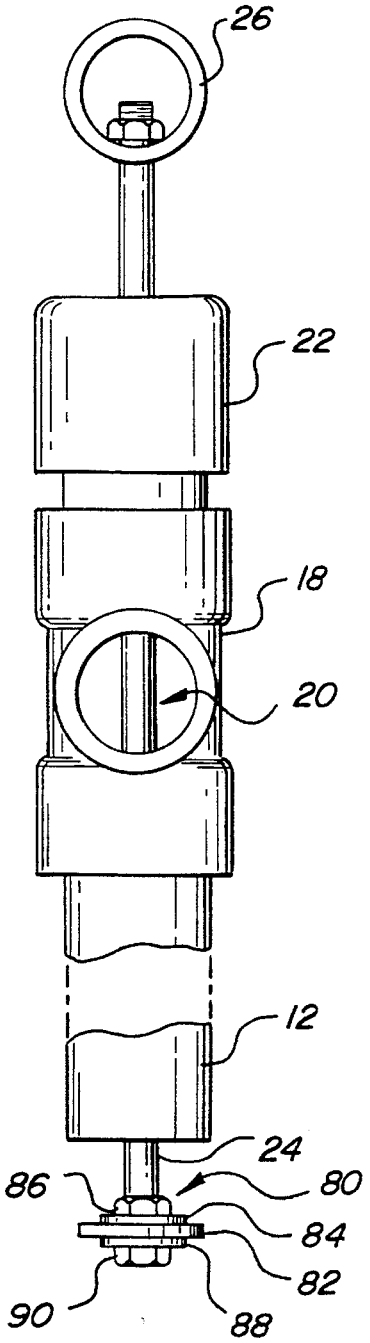
FIG - 5

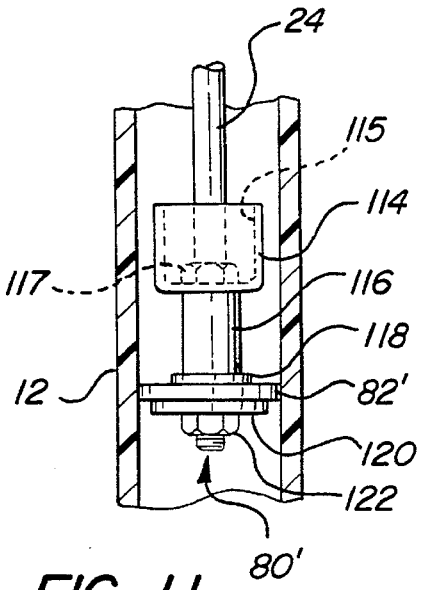
FIG-11
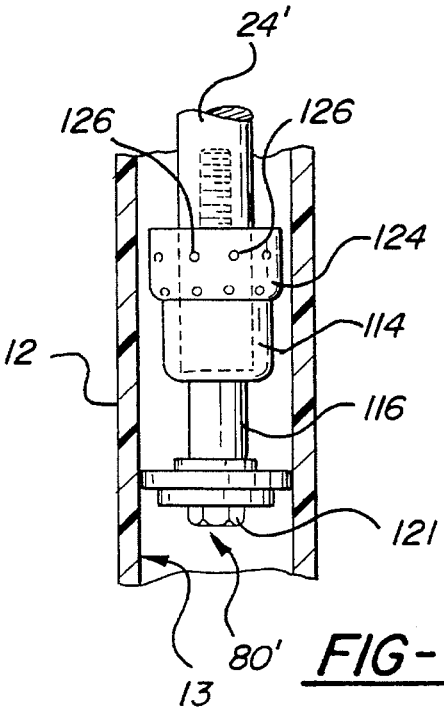
FIG-14
FIG-12
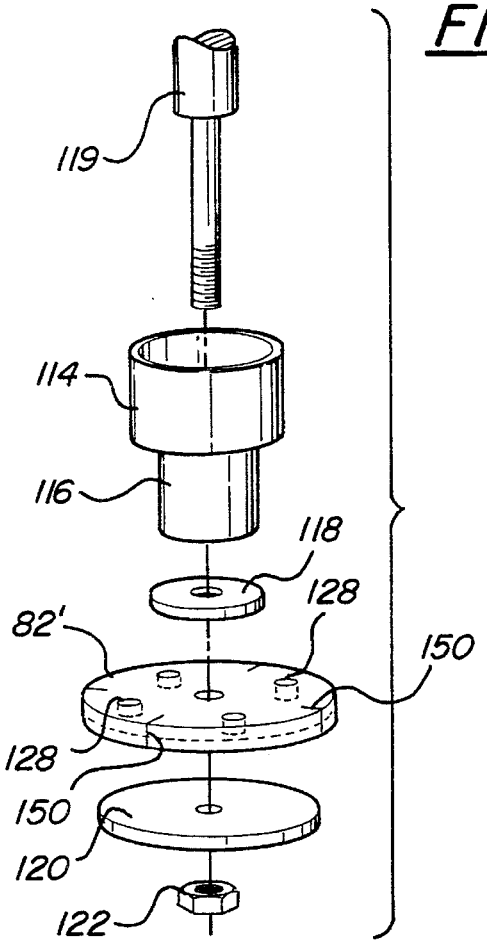
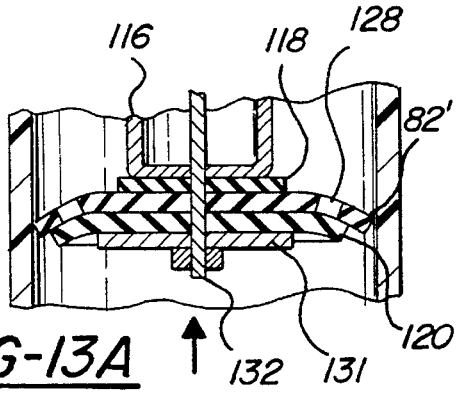
FIG-13A
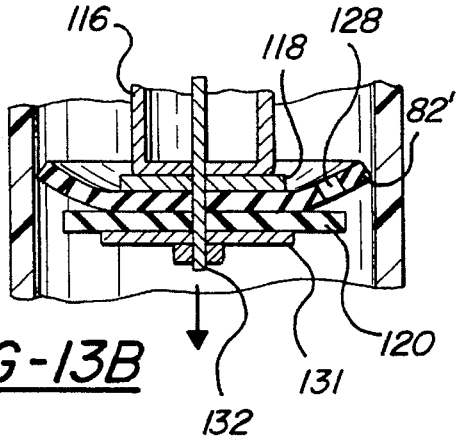
FIG-13B FIG-15
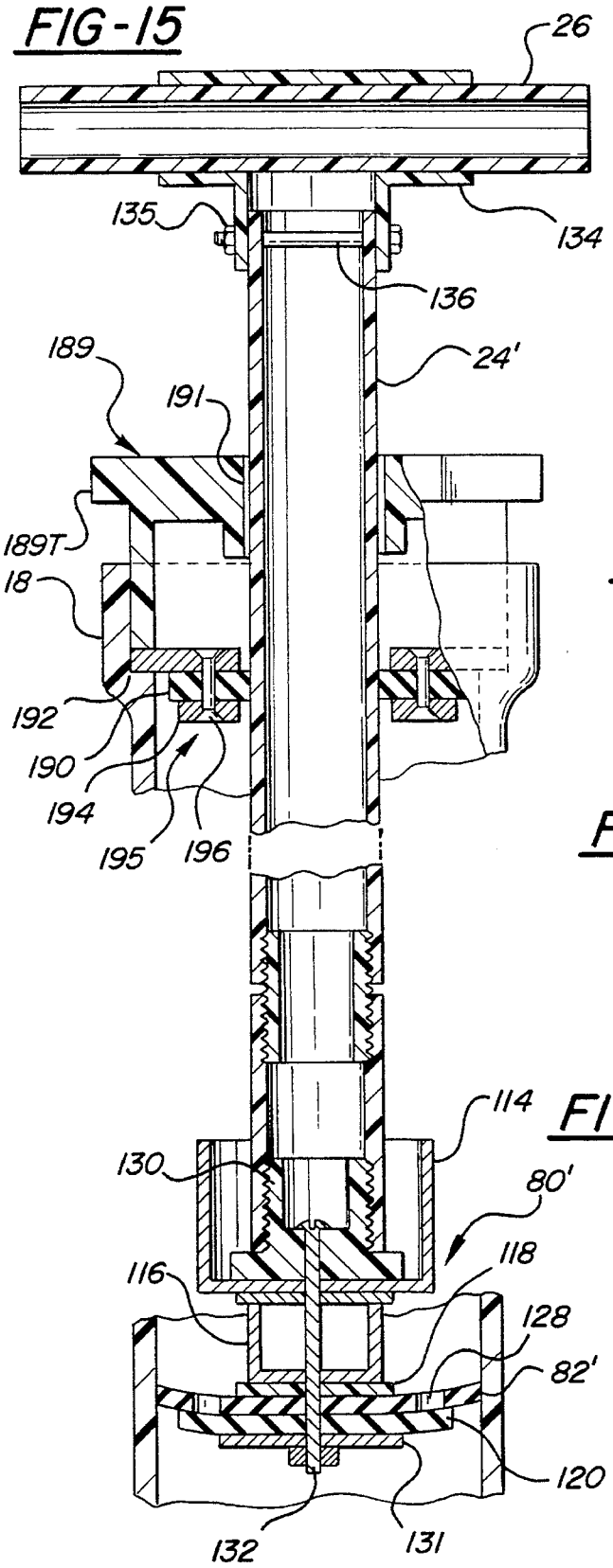
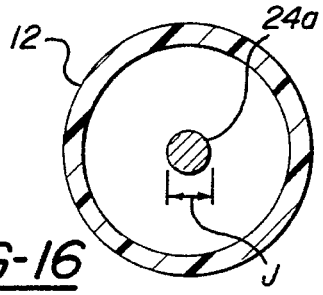
FIG-16
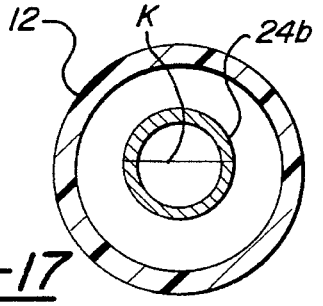
FIG-17
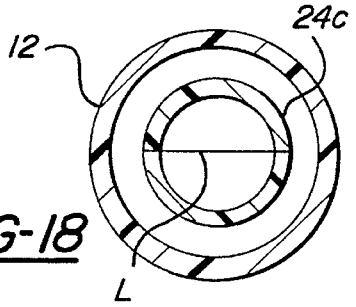
FIG-18
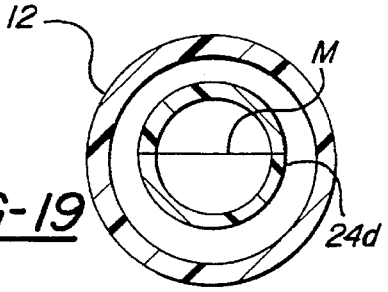
FIG-19
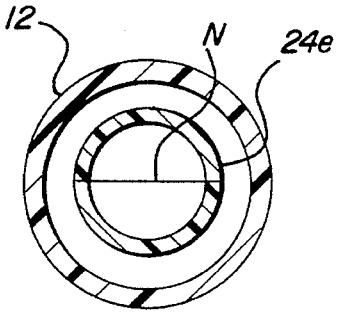
FIG-20

HAND-OPERATED LIQUID PUMP WITH REMOVABLE PARTS

BACKGROUND OF THE INVENTION

1. Technical Field

This invention relates generally to low-cost, portable, hand-operated liquid pumps, such as hand-operated bilge pumps which are commonly employed to remove a body of collected water from a sump, small vessel or hole, and more particularly to improved field-repairable, light-weight, robust versions of such portable hand-operated liquid pumps.

2. Discussion

Manually-operated liquid hand pumps such as bilge and sump pumps are commonly employed to remove or pump collected liquid, such as water, from a given spot. For example, a hand pump user may easily pump out water that has collected in the bottom of a boat (i.e., bilge) or a sump in the lower portions of a building. For landscaping, irrigation installation, and construction applications, a portable hand pump may be conveniently used to remove water that has collected in foundation trenches, ditches, valve boxes, meter boxes, or holes at an excavation site. These and a wide variety of other applications may be easily accomplished with the use of a portable hand pump to avoid having to bail such liquids with a bucket, or employ other less convenient approaches, such as an electrically-operated hand pump.

A variety of manually-operated hand pumps have been developed and are commercially available. The conventional liquid hand pump generally includes a plunger mechanism which has a flexible seal which slidingly engages the smooth inner wall or bore of a tubular housing. The typical hand pump also has an inlet port and a check valve assembly located at the bottom end of the housing, and an outlet port located near the top end. The plunger mechanism is forcibly displaced through an up and down motion, i.e., reciprocal movement, within the housing by a push rod with handle that is operated by back-and-forth arm movements of a user. The plunger mechanism sealingly engages the inner walls of the tubular cylinder on the upstroke. This generally causes liquids that have collected above the plunger to be pumped out the outlet port. It further creates a partial vacuum below the plunger which sucks in more liquid through the inlet port. On the downstroke, the liquid held in the bore of the housing cannot escape through the inlet port because of the check valve. Thus, it is forced to flow past the pliant outer edge of the flexible seal as the plunger moves toward the bottom of the housing.

While prior art pumps of the manually operable type are widely used, many of the existing liquid hand pumps are designed, manufactured and sold as disposable units with pumping components which are permanently sealed together. However, hand-operated liquid pumps are generally known to be susceptible to mechanical failures, especially when pumping liquids containing mud, sand and other particulate. Because the prior art pump units are made up of components that are not easily accessible or replaceable, it is very difficult or impossible for a user to repair a component such as the plunger mechanism when repairs become necessary. Accordingly, the user is generally expected to replace the entire hand pump when failure occurs. This can be particularly bothersome to a user who would rather replace or repair an inexpensive component and be back in business within a few minutes with a serviceable pump, instead of having to leave the job site and make a trip to a store to purchase an entirely new pump at an added cost.

In addition, many of the prior art liquid hand pumps are designed to pump liquids out the exhaust or outlet port primarily during the upstroke of the plunger mechanism, and very little on the downstroke. Accordingly, the prior art pumps are not believed to provide for optimum pumping capacity in each direction. Such prior pumping approaches tend to ignore the ergonomics of reciprocal movement, and the amount of physical strength required by the user in each direction, especially for larger pumps where greater manual force is necessary to pump larger volumes of liquids.

Moreover, commercially available liquid hand pumps fail to accommodate the user who would like a versatile pump which can perform a variety of pumping operations. Adapters, connectors and removable fluid lines are not provided and thus the utility of the pump is greatly limited It is therefore one object of the present invention to provide for an improved hand-operated liquid pump that is manufactured and assembled with inexpensive components that are easily connected together in a manner that enables a user to easily disassemble and repair the pump with a few simple hand tools when necessary.

It is a further object of the present invention is to provide a versatile hand pump kit that has a preselected group of interchangeable connectors, adapters, fittings, extenders, and accessories to choose from, which group easily enables a user to employ the pump under a variety of conditions, and for a variety of purposes or uses.

A still further object of the present invention is to provide for an improved hand pump that is capable of efficiently and ergonomically pumping liquid during both the upstroke movement and downstroke movement of the plunger mechanism.

One more object of the present invention is to provide for several improvements in the plunger mechanism that substantially sealingly engages the bore of the pump during the upstroke movements but yet requires reduced effort to operate in both stroke directions.

Yet another object of the present invention is to provide a manually-operable liquid hand pump which requires no glues for the assembly of the individual components to make the completed hand pump.

One more object of the present invention is to provide a repairable hand pump in order to reduce the amount of plastic or other pump components presently discarded into our society's waste stream when unrepairable pumps become unusable due to one or more damaged or worn components.

Finally, a further object of the present invention is to provide for a sturdy liquid hand pump that addresses the above-specified needs and yet is inexpensive, easy to use, to understand, and to repair to render the pump virtually good as new.

SUMMARY OF THE INVENTION

In accordance with the teachings of the present invention, a hand-operated liquid pump is provided which includes a substantially cylindrical housing with an internal bore and a bottom end forming an inlet port and a top end with an outlet port located near the top end. A plunger pump assembly has a plunger mounted in the internal bore of the housing which is connected to a push rod and handle for enabling a user to manually reciprocate the plunger within the housing using upstroke and downstroke motions applied through the rod's handle. A unidirectional valve such as a check valve is operatively coupled to the bottom end of the housing to allow liquid to flow in a direction from the inlet port toward the outlet port while preventing liquid flow in the opposite direction. The housing includes a three-way connector provided with a first passage engaged with the top end of the housing, a second passage forming the outlet port and a third passage connected to the lower portion of the housing. The pump has removable connections at the top end and/or the bottom end, which may be threaded or twist-lock fit, as desired, to provide easy access to the plunger mechanism to allow it to be repaired in the field. In addition, the pump has a variety of connectors from which a user may choose to attach to the inlet and outlet ports to perform a variety of pumping operations.

Preferably, the plunger mechanism has first and second diaphragms, with the first diaphragm being in sliding engagement with the internal bore and having a few through holes formed therein. The second diaphragm abuts the first diaphragm and sealingly engages the holes in the first diaphragm during upstroke movement while allowing liquid to flow through the holes during downstroke movement. Further, an enlarged cup-like sleeve member may be connected to the rod above the pliable sealing member of the plunger mechanism which rides up and down within the pump housing. This sleeve member acts to substantially reduce those dynamic forces created by the lifting of a column of liquid during the upstroke movement of the pump rod. This in turn increases pumping efficiency since a more compliant sealing plunger member may be used to reduce plunger drag. The pliable member of the plunger mechanism includes at least a first resilient diaphragm that engages the internal bore, and optionally may include a second diaphragm member as well.

One advantage of the hand pumps of the present invention is that no chemical glue or solvent is required as part of constructing this pump, even though it is made primarily from plastic components, such as PVC tubing and fittings, which traditionally are cemented together with glues. In particular, the use of twist-lock friction fittings between plastic components of the hand pump provides a strong connection between the various components which can be successfully disassembled as may be required in order to access one or more of various internal seals or plunger assemblies for repair or replacement of same. Then, the pump components can be put back together, again without glue, in a matter of a few moments, so that the pump can be put back into service.

Another advantage of the pumps of the present invention is that each component is replaceable if it should break, typically with low-cost replacement parts that are readily available in most hardware or plumbing supply stores. There are specific parts which are expected to wear out with long, extensive use or rough use, such as the plunger seal. One or two extra plunger seals, which serve as replacements, may be sold as part of the initial hand pump kit, to facilitate simple repairs by the user at home, on the boat, or on at the job site.

Still another advantage of certain hand pumps of the present invention is that they provide an ergonomic pumping action, characterized by equal pumping action or volume in both the upstroke direction and the downstroke direction. This is accomplished by selecting a rod that considerably larger than normal relative to the bore diameter.

Still other advantage of two more embodiments of the hand pumps of the present invention are that they provide between about 33 percent and about 100 percent liquid being pumped on the downstroke than on the upstroke. This is achieved by pump rod area being about 33 percent and about 100 percent greater that the annular area between the pump rod and the inner bore of the housing.

Other successfully accomplished objects and/or advantages of the present invention will become apparent to those skilled in the art upon reading the following detailed description and upon reference to the drawings which form part of this specification.

BRIEF DESCRIPTION OF THE DRAWINGS

In the various Figures, where like components are indicated by the same reference numerals:

FIGS. 1 through 8 are various views of a first embodiment of the liquid hand pump and accessory kit of the present invention, which includes a predetermined group of pump accessories that may be selectively attached to inlet and outlet ports or each other for use in connection with the hand pump, where:

FIG. 1 is side elevational view of a first embodiment of the liquid hand pump of the present invention, along with the group of pump accessories;

FIG. 2 is a longitudinal cross-sectional view of the FIG. 1 hand pump taken through the major axis of the housing and showing a check valve inlet assembly attached to a bottom end of the pump housing;

FIG. 3 is a bottom end view of the FIG. 1 pump showing the holes in the inlet assembly attached to the bottom end of the pump housing;

FIG. 4 is an exploded side cross-sectional view of the FIG. 2 inlet assembly showing the general arrangement of a check valve normally assembled therein;

FIG. 5 is a front elevational view of the FIG. 2 hand pump with the inlet assembly removed and pump rod fully extended to allow access to a plunger assembly normally disposed in and reciprocable within the pump housing;

FIG. 6 is a partial cross-sectional view of a first outlet accessory that is adapted to connect to the outlet port of the FIG. 1 pump, namely a check valve and shut off valve assembly;

FIG. 7 is a partial cross-sectional view of a bottom check valve connector with attached tubing connector which connects to the inlet port of the pump; and FIG. 8 is an end view of a perforated support plate in the check valve connector of FIG. 7;

FIG. 11 is a side elevational view of a second embodiment of the plunger assembly of the present invention shown within a fragmentary cross-sectional portion of the pump body, which assembly has a rigid cup-like member located above the flexible diaphragm;

FIG. 12 is an exploded elevational view of the plunger assembly shown in FIG. 11;

FIGS. 13A and 13B are cross-sectional views of the plunger assembly showing movement of the flexible diaphragm for respective upward and downward movements;

FIG. 14 is a side elevational view of a third embodiment of the plunger assembly of the present invention, also shown within a fragmentary cross-sectional portion of the pump body, which features an enlarged perforated pressure-deflecting pump member;

FIG. 15 is a longitudinal cross-sectional view of a third embodiment of the hand-operated liquid pump of the present invention, featuring a different handle arrangement, an all-plastic pump rod and a fourth embodiment of a plunger assembly which features two resilient plunger members; and FIGS. 16 through 20 are cross-sectional views taken through the pump housing which illustrate five different pump rods, each of a different size, for the hand pumps of the present invention which may be employed to carry the plunger assembly up and down along the bore of the pump housing having a diameter B, where FIG. 16 shows a metal pump rod with a small diameter J, FIG. 17 shows a hollow metal pump rod having a larger diameter K, FIG. 18 shows a hollow plastic pump rod with a larger diameter L, FIG. 19 shows a hollow plastic pump rod with an even larger diameter M, and FIG. 20 shows a hollow plastic pump rod with yet a larger diameter N.

DETAILED DESCRIPTION OF THE PREFERRED EMBODIMENTS

The following description discusses the details of presently preferred embodiments of the hand-portable, hand-operated liquid pump of the present invention, which are well-designed to fulfill the objects and achieve the advantages of the present invention. Those skilled in the art should appreciate that my hand-operated liquid pumps described and shown herein are merely exemplary of the scope of my invention, as defined by the patent claims below, and are subject to variation and change without departing from the scope of my invention as defined by those claims.

Figure 1:
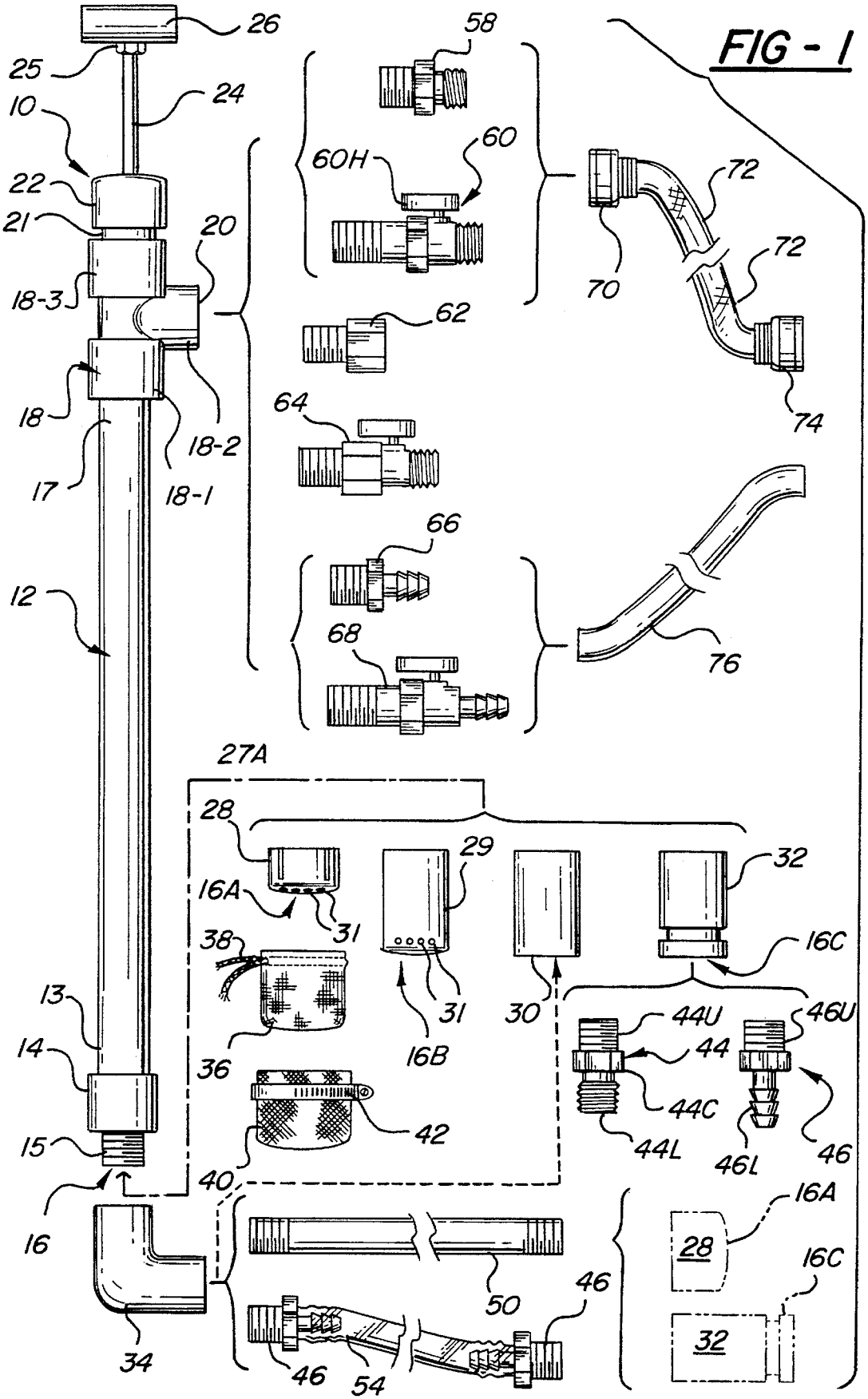

Turning now to FIG. 1, a hand-operated liquid pump 10 is shown arranged with a variety of pump accessories which form a pump assembly kit from which a user may select desired accessories for use in connection with the hand pump 10. The hand pump 10 includes an elongated cylindrical housing 12 which may be made of commercially available Schedule 40 polyvinyl chloride (PVC) plastic pipe or other suitably rigid non-corroding piping or tubing material, (e.g., metal, plastic, hard rubber etc.). The housing 12 has a bottom end 13 which is engaged by a press-fit bottom connector 14 which has a bottom threaded portion 15 for engaging a selected inlet fitting. The bottom end of the housing 12 is sealingly attached then to bottom connector 14 and one of several possible inlet fittings which are placed thereon. The inlet fitting includes and forms an inlet port 16 for receiving liquid such as water to be pumped. Thus, depending upon what fitting is used, the inlet port 16 may be found at location 16A, 16B or 16C.

The pump housing 12 has a top end 17 which is engaged by a three-way or tee-connector 18. Connector 18 has three interconnected cylindrical through-passages. The first passage 18-1 is connected to the housing 12. The second passage 18-2 forms an outlet port 20, and the third passage 18-3 is engaged by a pipe 21 leading to a top connector 22. The top connector 22 has a central hole (not shown in FIG. 1) formed therein through which a metal pump rod 24 extends. The pump rod 24 has a threaded top end and is connected by a pair of nuts 25 to a hollow handle 26 so that a user may forcibly reciprocate the rod 24 and a plunger mechanism connected to the lower end of the rod 24 inside the pump housing 12 in upstroke and downstroke movements. Such reciprocal motion of the plunger mechanism operates to pump liquid into the inlet port 16 and out of the outlet port 20, as will be more fully explained below.

As indicated by the dashed arrow line 27A and bracket symbols in FIG. 1, a user of the pump 10 may choose from a variety of inlet connector fittings that engage the threaded end portion 15 of bottom connector 14 for purposes of performing a wide variety of liquid pumping operations. A combination of the inlet pieces may be connected if desired at any one time to bottom connector 14. In addition to one of the connector fittings, the combination may include rigid or flexible extender members as will be described shortly. In every instance and with every combination of inlet pieces, there is included among the inlet fittings a check valve inlet assembly of which structure 28 is typical. Check valve inlet assembly 28, which is also shown in FIGS. 3 and 4, includes a plurality of through holes 31 for receiving liquids and a check valve 180 for allowing liquids to flow into the inlet assembly 28 and the bottom end of housing 12 while preventing liquid flow in the opposite direction. Holes 31 are preferably sufficiently small to keep out large debris such as pebbles that might be swept into the pump, and are preferably sufficiently numerous to allow sufficient flow at low suction pressures.

In addition, a medium-to-fine mesh filter device 36, which may be made up of a woven cloth material or a fine mesh non-woven porous material, for example, may be placed over the check valve fitting assembly 28 and fastened thereto via an elastic strap 38 or other suitable fastening means to cover the holes 31 and provide a fine filtering device for filtering out mud, dirt or other particulate from liquids flowing therethrough. The device 36 may take the form as shown of a cup-like bag having an elastic band sewn into the top edge portion of the bag, for example. Furthermore, a slightly larger, cup-shaped coarse mesh filter device 40 preferably made of wire mesh or coarse non-woven material may further enclose the fine mesh device 36 and check valve fitting assembly 28. When used, device 40 provides coarse filtering of rocks, gravel, debris or other coarse particles and protects the finer mesh filter 36 from being punctured or abraded. The coarse wire filter 40 may be removably secured in place thereon via clamp 42, as shown, or by using a conventional screw-operated, metal automotive hose, an outer elastic band or other suitable fastening means, such as a flexible metal wire whose ends are tightened by twisting (not shown). Bag 36 may also be fastened securely to inlet fitting 28 in this manner.

The selection of available inlet pieces may further include a hollow rigid cylindrical coupler 30 which may be threaded internally at one or both ends in order to be adapted to engage an extension member that provides an elongated inlet port. The extension member may take the form of a hollow cylindrical pipe 50 having threaded ends if desired, or a flexible tubing or hose 54. The extension member must be connected to a check valve inlet assembly such as assembly 28 or assembly 32 which will shortly be described in order to achieve proper unidirectional liquid flow through the pump.

A cup-like check valve assembly 29 open at the top end may likewise be employed as an inlet fitting. Assembly 29 has a plurality of inlet holes 31 formed in the side walls thereof near the closed bottom end along an elevation below the internal check valve that is assembled therein. The use of inlet holes 31 on side walls allows a user to depress the closed bottom end of connector 29 against a surface without sealing or prohibiting liquid flow through the inlet holes 31.

Figure 7:
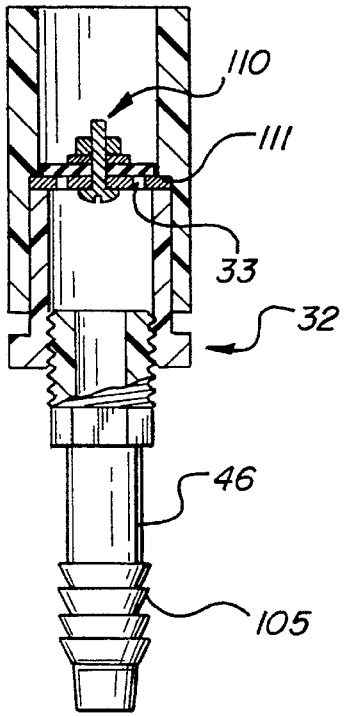

A check valve coupler fitting 32, which is described in further detail with respect to FIG. 7, may likewise be connected to bottom connector 14. Check valve coupler 32 has a check valve assembled therein, and is further adapted by virtue of internal pipe threads formed in its lower end to receive for attachment a conventional hose coupler 44 or tube connector 46, each of which include hollow bores to permit liquid to pass therethrough. Hose connector 44 includes an upper end portion 44U having external pipe threads, an enlarged hexagonal center section 44C, and a lower end portion 44L having conventional external garden hose threads, for threadingly receiving a standard female fitting found on a length of conventional garden hose (not shown).

The tubing connector 46 includes an upper end portion 46U having external pipe threads, an enlarged hexagonal center portion, and a lower barbed fitting portion 46L with triple-conical regions in succession for removably receiving flexible tubing which may be pushed thereon.

The outlet fittings shown in the upper right half of FIG. 1 which connect to outlet port 20. These outlet fittings 58 through 68 each have first connection portion (shown on the left in FIG. 1), a center portion, and second connection portion (shown on the right in FIG. 1) and a liquid-carrying axially-arranged passage extending therethrough. The fittings 60, 64 and 68 each include, in the center portion thereof, a shut-off valve which can be used to interrupt the flow of liquid through the passage in the fitting. The shut-off valve in each of these fittings may be a conventional heat valve or ball valve or any other suitable valve, the construction of which is well known and need not be described here. The shut-off valve may include a hand-operator, such as operator 60H shown on fitting 60.

The fitting 62 has in its center portion an internal check valve for allowing liquid flow through valve 62 only in the direction from left to right as shown in FIG. 1. The check valve may be constructed in any suitable manner, including but not limited to that shown for check valves in connection with inlet fitting 28.

The first connection portion on the left end of each of the outlet fittings 58 through 68 is comprised of external pipe threads sized to be threadingly engaged in female threads of outlet port 20. The second connection portion on the right end of outlet fittings 58 and 60 may be conventional water faucet male threads. So too may the right connection portion of valve 64. In this manner, a conventional garden hose 72 with female water faucet connectors 70 and 74 may be attached to the right-hand end of outlet fittings 58, 60 and 64. Alternatively, the outlet valves may be in the form of a triple-conical tubing connector for removably receiving flexible tubing 76.

Those skilled in the field will appreciate that the inlet and outlet connections may be male or female, as desired. Thus, for example, if the outlet port 20 is a threaded male connection, the corresponding first connection portion on the outlet fittings 58 through 68 would be a complementary threaded female connection portion. Likewise, if the inlet fitting 14 had a female connection portion, the inlet attachments would correspondingly have a complementary male connection portion.

Further, outlet port 20 may be designed as any conventional or suitable liquid tight connection if desired, male or female. One such non-threaded connection which may be used is the conventional twist-tight connection commonly used with PVC pipe fittings which comprises complementary, slightly tapered, interference-type male and female unthreaded connections. In such a case, the first connection portion on the left end of each of the outlet fittings 58 through 68 would be unthreaded, complementary to and suitably sized to mate in a liquid-tight fashion with a corresponding connection at the outlet port 20. In this regard, the outlet port may be a male connection member, and the left-side connection portion of fittings 58 through 68 may be a female connection portion for engaging the inner bore of an elastomeric tube material such as rubber tubing 76. An elongated hose or tube therefore advantageously provides a flexible extension through which liquids may be received.

The inlet fitting connected to the bottom connector 15 may alternately be a hollow 90° elbow connector 34, which in turn may be connected to a rigid straight hollow tubular extension pipe 50 or a flexible hose 54.

The tubular extension 50 or flexible hose 54 in turn may be connected to either check valve fitting assembly 28 or 32. It is conceivable that one may interconnect the above-referenced inlet fitting attachments in a number of arrangements without departing from the teaching of the present invention. However, as noted above, it is necessary that a check valve assembly (or other suitable one-way flow device) be included with the inlet port arrangement to provide the necessary one-way inlet flow of liquids.

Outlet coupling 60 is equipped with a shut-off valve which enables a user to manually close the valve to prevent liquid flow in either direction. This allows for transportation of the pump 10 with the valve closed to prevent liquids from spilling out of the outlet port 20.

Each of the outlet fittings may further include a check valve connector 62 or a combination check valve and shut-off valve connector 64. The addition of a check valve connected to outlet port 20 prevents the flow of liquids back into the outlet port 20. This may allow liquids to be pumped to higher levels of elevation so that the outgoing liquids do not flow back into the outlet port 20. In addition, the selection of outlet fittings may further include an outlet hose coupling 66 and a shut-off valve coupling 68 with a tube connector. Couplings 66 and 68 may further be connected to a garden hose, tubing 76, or other flexible extension as desired. While a particular arrangement of outlet fittings are shown and described herein, it is conceivable that a variety of combinations of such fittings may be provided without departing from the teachings of the present invention.

In FIG. 2, the liquid hand pump 10 is shown connected to the check valve inlet assembly 28. The handle 26 is preferably a rigid plastic piece tubing made of polyvinyl chloride (PVC) which has a hole formed therein for engaging pump rod 24. A threaded portion of pump rod 24 extends through the hole into the inner regions of the handle 26 and is fastened to the handle 26 with the pair of nuts 25.

The pump rod 24 is made of a non-corrosive rigid material such as a stainless steel or copper bar or may include a polyvinyl chloride (PVC) plastic tubing. Rod 24 extends into the tubular housing 12 and has a plunger mechanism 80 connected at the bottom end portion thereof. The plunger mechanism 80 is also shown in detail in FIG. 5 and includes a flexible rubber disc-shaped diaphragm 82 fastened onto pump rod 24 between a pair of support washers 84 and 88 by nuts 86 and 90. The rubber diaphragm 82 slidingly engages an internal bore 13 of pump housing 12. Plunger mechanism 80 is operated so that the rubber diaphragm 82 flexes during downstroke movement so that liquids pass between diaphragm 82 and bore 13. During upstroke movement, plunger mechanism 80 sealingly engages internal bore 13 and pulls liquids thereabove toward outlet port 20, while creating a vacuum to suck in more liquids into the inlet port 16.

The check valve inlet assembly 28 is further shown in FIGS. 3 and 4. Inlet assembly 28 includes the plurality of holes 31 extending through the bottom wall for receiving liquids. The check valve 180 is assembled inside the inlet assembly 28 and includes a flapper diaphragm 182 which is arranged adjacent to and abutting the inner surface 183 of the bottom wall of inlet assembly 28. A washer 184 and nut 186 engage bolt 188 to secure the check valve assembly therein. Accordingly, the rubber flapper diaphragm 182 allows liquids to flow into the inlet port 20 through holes 31, while sealingly engaging the plurality of holes 31 to prevent liquid flow in the opposite direction.

As best shown in FIG. 2, the top end of the pump 10 is formed by closed-end cap fitting 22 having a hole therethrough through which rod 24 slides. Cap fitting 22 engages cylindrical plastic pipe 93, which in turn engages the top bore of three-way connector 18. The pump rod 24 is sealingly engaged with a rubber or closed-cell foam gasket 90 that is compressed between a pair of washers 92 and 94 in a region between the top connector 22 and connector 18. Washers 92 and 94 cooperate with a top washer 96 located in the top region of top connector 22 to guide the pump rod 24 through the housing in an up and down motion while stabilizing the rod 24. One advantage of the construction shown in FIG. 2 for the top end of pump 10 is that the degree of compression on compression gasket 90 may be controlled by the amount of force used to jam tube 93 into three-way connector 18. Preferably, this connection is a twist-lock connection which remains unglued. In general, these twist-lock connections between plastic PVC tubing, for example, appear to increase in strength with age. After several hours, such twist-lock connections made with PVC tubing 93 and connector 18, for example, require the use of hand tools, such as two pairs of large adjustable pliers, to disassemble. Thus, once assembled, even without glues or other chemical solvents (as is customarily used when connecting PVC or similar tubing), the twist-lock connection is satisfactory when the hand pump 10 is in use, since it does not leak. In addition, since the connection is preferably not glued, the compressed seal or gasket 90 can be serviced when worn to the point of unacceptable leakage, simply by unlocking this connection between cylindrical tube 93 and connector 18. Then, a replacement gasket 90 may be inserted, and the pump reassembled for an additional period of long service.

Another advantage of this style of glueless construction is that the compression seal 90, if it should ever leak, can simply be re-compressed more tightly. This is done by breaking the connection between tube 93 and the top bore of connector 18, and more forcefully squeezing metal washers 90 and 94 together to further compress the compression gasket 90, which will force the inner annular portion of the gasket 90 radially inward against the pump rod surface, thus re-establishing a proper substantially leak-free seal between rod 24' and gasket 90 even without replacement of the gasket.

The hand pump 10 as illustrated in FIGS. 2 and 5 is designed so that the inner fitting such as check valve inlet assembly 28 may be easily removed by a user. The pump rod 24 has a length sufficiently long so that the plunger mechanism 80 may be extended beyond the bottom end of housing 12 to provide access to the plunger mechanism 80. As shown in FIG. 5, the pump rod 24 is fully extended in the downstroke motion so that the plunger assembly 80 extends beyond the bottom end of housing 12. It is not uncommon for portable liquid hand pumps known in the art to undergo failures with the plunger mechanism through prolonged use and aging. The easy accessibility to the plunger here allows for a user to easily repair or replace the plunger mechanism 80 and to further clean the internal bore 13 of the housing 12 from any unwanted materials that may have collected and lodged in the housing 12.

Figure 6:
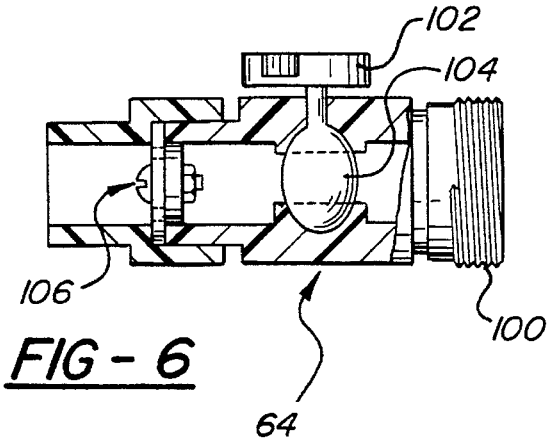

Turning now to FIG. 6, the outlet coupling 64 with the check valve and shutoff valve combination is shown in detail therein. Outlet coupling 64 includes a threaded end 100 for threadingly engaging the outlet port 20 via the three way connector 18. A shut-off valve 104 is manually controlled by lever 102 to open and close the valve to the direction and amount of liquid flow therethrough. Coupler 64 further includes a check valve 106 for preventing liquid flow back into the outlet port 20. Check valve 106 is similar to the check valve previously shown and described in connection with FIG. 4.

Figure 8:
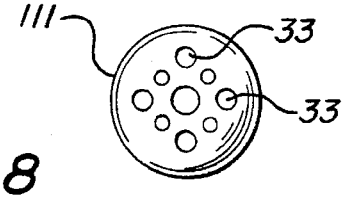

FIG. 7 illustrates check valve inlet assembly 32 attached to tubing connector 46. The check valve inlet assembly 32 includes a check valve 110 for allowing liquids to flow into the inlet port 16 through the tube connector 46. Tube connector 46 includes a ribbed coupler 105 for coupling with the inner bore of an elastomeric tube such as rubber tubing. Inlet connector 32 further includes a plurality of holes 33 formed in a disc-shaped member 111 as shown in FIG. 8.

Figure 9:
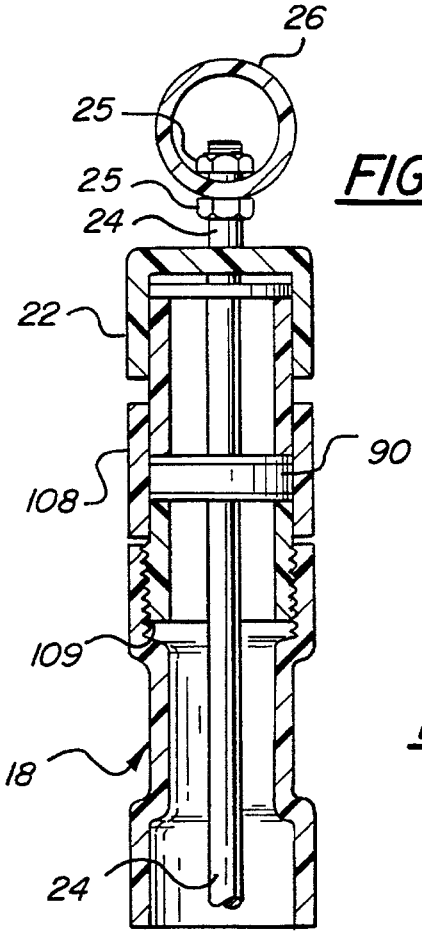
FIG. 9 is a cross-sectional view of an upper portion of a second embodiment of the hand pump of the present invention, taken through a longitudinal front section of the pump, and showing a removable top connector.

FIG. 9 illustrates an alternate embodiment of the liquid hand pump 10 which includes the addition of a removable connector 108 attached between top connector 22 and the three way connector 18. According to this embodiment, the rod seal 90 is preferably mounted within connector 108. Removable connector 108 may be unscrewed by a user so that the top connector 22 along with pump rod 24 and the plunger mechanism 80 may be removed from the housing 12. This provides an alternate approach to accessing the plunger mechanism 80 for purposes of repairing or replacing worn components and to remove foreign objects that may have collected or are lodged in the housing 12. Thus, in this second embodiment of the hand pump 1, the pump rod 24 need not be as long as in the first.

Figure 10:
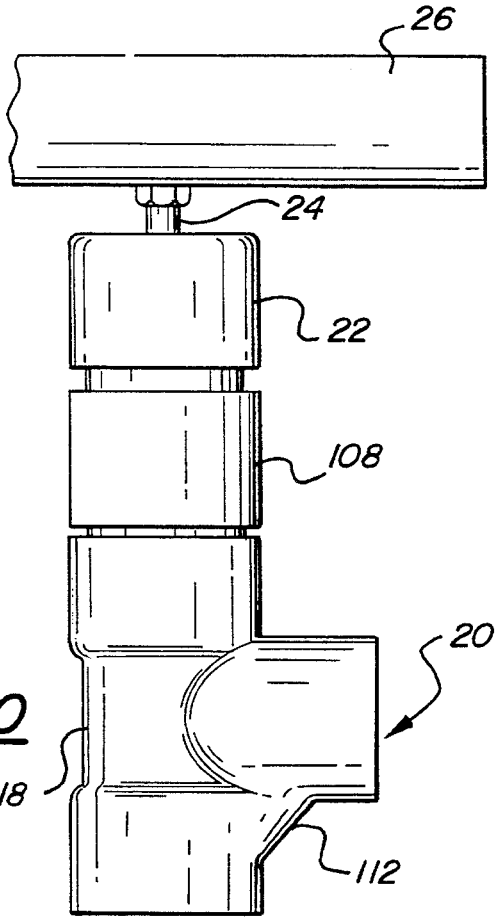
FIG. 10 is a side elevational view of an upper portion of the FIG. 9 hand pump.

A side view of the alternate embodiment of pump 10 is shown in FIG. 10 along with an alternate three way connector 18. Three way connector 18 includes the addition of a sloping bottom edge 112 that forms a semi-Y shape to enhance liquid flow from housing 12 out of outlet port 20.

A second embodiment of the plunger mechanism referenced by 80' is shown in FIGS. 11 through 14 with two types of sleeve members included therewith. The plunger mechanism 80' has a plurality of openings 128 extending through the rubber diaphragm 82'. A second rubber diaphragm 120 is fastened to the bottom side of diaphragm 82' via nut 122 and abuts openings 128 so as to form a flapper valve. That is, the second diaphragm 120 flexes so as to allow liquid to flow through opening 128 during downstroke movement. During upstroke movement, on the other hand, second diaphragm 120 sealingly engages the openings 128 and thereby prevents liquids from passing through openings 128.

In addition, plunger mechanism 80' may include a cup-like sleeve member 114 which has an aperture 115 facing upwards as shown in FIGS. 11 and 12. The sleeve member 114 is fastened to pump rod 24 via nut 117 in FIG. 11, while FIG. 12 replaces nit 117 with a stop block 119 for engaging the bottom of sleeve member 114. The sleeve member 114 is preferably located above and close to rubber diaphragm 82'. The sleeve member 114 is separated from diaphragm 82' by a narrower sleeve portion 116 and a protective rubber pad 118. The narrow sleeve portion 116 allows rubber diaphragm 82' to flex upwards freely while undergoing a downstroke movement. Accordingly, cup-like sleeve member 114 advantageously pulls a vast majority of liquids from the pump housing 12 out toward the outlet port 20 during an upstroke movement. This relieves a portion of liquid flow pressure that would otherwise be applied to rubber diaphragm 82' without this cup. As a consequence, a more flexible rubber diaphragm 82' may be employed for a given pump which can decrease the amount of force that is necessary to complete a downstroke movement.

In FIG. 12, the rubber diaphragm 82' is also shown with four small slits 150 provided in a direction transverse to the circumference. These slits 150 are preferably equiangularly spaced about the periphery of the rubber diaphragm 82', and may range in number from one to ten or more, with three to five slits being preferred. The purpose of slits 150 is to reduce the amount of frictional force experienced between the diaphragm 82' and the inner bore 13 of cylindrical housing 12. Tests have shown that when diaphragm 82 or 82' is made to fit tightly within the bore 13, suction is increased, but also frictional forces which resist upstroke and downstroke are also increased. The use of slots 150 dramatically decreases this resistance. It is believed that the slits 150 open slightly during vigorous upstroke and downstroke movements of the push rod 24, thus partially breaking the suction being experienced, and also reducing the frictional forces. In any event, the use of these slits provides for easier upstroke and downstroke movement. Preferably, these slits are radially arranged, and each extends no further than ⅛ to ⅙ of the total diameter of the diaphragm 82 or 82'.

With particular reference to FIGS. 13A and 13B, the use of plunger mechanism 80' in cooperation with the internal bore 13 of housing 12 is shown for upward movement in FIG. 13A and downward movement in FIG. 13B. During upward movement, rubber diaphragm 82', which is oversized for bore 13, flexes so the outer portions thereof bend downward while abutting bore 13. While this occurs, holes 128 are engaged and sealed with second diaphragm 120. During the downward movement, rubber diaphragm 82' flexes so the outer portions bend upward. This in turn breaks the sealed engagement of holes 128 with second diaphragm 120 and allows liquid to pass through the holes 128 and between the outer portion of diaphragm 82' and bore 13.

It is generally necessary to require that the size of sleeve member 114 may not be so large as to adversely affect the ability to liquid flow surrounding sleeve member 114 during downstroke movement. However, a larger sleeve member such as enlarged member 124, shown in FIG. 14, may be employed in combination with a sufficient amount of openings 126 formed therein. The openings 126 reduce the amount of liquid pressure differential that would otherwise exist for a large sleeve member 124 during downstroke movement. The enlarged sleeve member 124 also allows for an enlarged diameter pump rod 24' with a bolt threadingly engaging an internal bore within the rod 24' to secure the plunger mechanism 80' and sleeve members 114 and 124 in place.

The plunger mechanism 80' may easily be connected to pump rod 24 in accordance with another embodiment as illustrated in FIG. 15. In so doing, plunger mechanism 80' includes a plastic inner housing 130 with a threaded portion for engaging pump rod 24' and a bolt 132 which extends therethrough for fastening the remaining plunger mechanism components thereto. That is, diaphragms 82' and 120, sleeve members 114 and 116, a washer 131 and rubber pad 118 are fastened together as a single unit and then the unit is threadingly attached to rod 24'. According to this arrangement, the entire plunger mechanism 80' may be quickly removed simply by threadingly disengaging the inner housing 130 from pump rod 24'. A user may therefore quickly replace the entire plunger mechanism 80' or disassemble and replace or repair separate components thereof.

Also shown in FIG. 15 is the handle assembly 26 attached to the pump rod 24' according to an alternate embodiment. This attachment includes a T-connector 134 with the rod 24' inserted partially into one opening of connector 34. A through bolt 136 extends through holes (not shown) in the rod 24' and connector 134 and is fastened by nut 135. The handle 26 is snugly lodged within the T-connector 134 and extends from both ends of connector 134. Instead of a through bolt 136, a single screw passing through only one side of the wall of T-connector 134 and side wall of pump rod 24 may be used if desired. When repairing the pump 10, the bolt 136 (or screw) may be removed, the twist-lock coupling between pump rod 24' and the handle may be loosened, and then the pump rod 24', with the plunger assembly 80 or 80' still on it, may be removed from the bottom of the pump, once the inlet fitting assembly 14.

FIG. 15 also shows an alternate construction for the top end of the pump 10, which uses a single fitting 189 in place of the cap 22 and cylindrical tube 93 shown in the FIG. 2 embodiment. This fitting 189 may be a male to female slip-by-slip bushing appropriately sized to receive the pump rod 24' and fit into the top bore of the three-way connector. The top portion 189T of fitting 189 may have an octagonal or ten-sided outer cross-section when viewed from the top, which allows a wrench to be used on the opposite flats, when assembling or disassembling the fitting 189 into the three-way connector 18. In addition, the fitting 189 has a central bore 191 which is slightly larger than the diameter of the pump rod 24'. In the event that a standard slip-by-slip bushing does not have exactly the proper diameter for this purpose, it is an easy matter to use an appropriately sized drill bit to slightly enlarge the standard bore to fit the outside diameter of pump rod 24'. A snug-fit between cylindrical bore 191 and the pump rod 24' helps eliminate the need to use a compression seal to prevent liquid from flowing up through the cylindrical bore in which the pump rod 24 or 24' slides.

FIG. 15 shows a pre-assembled compression gasket structure 195 comprised of rubber gasket 190 sandwiched between metal washers 192 and 194 connected together by a plurality of blind rivets 196 which are preferably equiangularly spaced about the central axis of the structure 195. The rivets when set squeeze the washers 192 and 194 together slightly so as to compress the gasket 190 radially inwardly so it will gently squeeze the pump rod when it is placed through the central bore of the gasket. One benefit of using the pre-assembled gasket structure 195 is that the pump 10 may be assembled more quickly during manufacture. In addition, since the gasket structure 195 is preassembled, it may be manufactured to closer tolerances, thus providing a more predictable pre-engineered squeeze fit between gasket 190 and the pump rod 24' which passes therethrough. As noted above, this compression seal assembly structure 195 is optional, and can be eliminated if a small amount of liquid passing between the cylindrical bore 191 of fitting 189 and pump rod 24' is not objectionable. The gasket seal structure 195 also has the advantage of possibly being somewhat less expensive in terms of materials than that shown in FIG. 2, since the annular metal washer 194 can be made considerably smaller than the larger annular metal washer 192. In this regard, neither the annular gasket 190 nor the washer 194 need extend over the entire area occupied by metal washer 192. Although rivets 196 are shown, it should be appreciated that the structure 195 may be glued together by use of suitable adhesives. In addition, if the bond between washer 192 and gasket 90 is sufficiently strong and gasket material 190 is sufficiently robust, washer 194 may be eliminated.

FIGS. 16 through 20 also illustrate the use of solid and hollow metal pump rods and hollow plastic pump rods. These Figures show various size pump rods 24*a* through 24*e* in relation to pump housing 12, each would be depicted in a cross-sectional view transverse to the longitudinal axis of the hand pump. Thee portable hand pumps may be constructed using any of the designs or features illustrated in the earlier FIGS. 1 to 15. In FIGS. 16 through 20, the pumps thus have the same housing with a fixed diameter of the internal bore 13 of housing 12, and different diameters of the pump rod 24, are drawn generally to scale (that is, in proportion to one another). Sample dimensions of a hand pump whose housing has an outer diameter of about 2.5 inches and an internal diameter of about 2.2 inches are provided in the following table to illustrate certain bore area and rod area ratios. This table helps illustrate the advantages of using pump rod diameters which are much larger than those found in conventional pumps, in order to achieve a more ergonomic pumping action with the hand pumps of the present invention, which is especially used in situations I have considered. To help explain why this is important, I will discuss the pumping action in the upstroke (UPS.) direction and the downstroke (DnS.) direction for each size rod, assuming that the stroke distance in each direction is equal, which it is during repetitive pumping cycles. When the pump stroke is equal in both directions, the pumping volume in each direction is directly proportional to certain areas as follows. The pumping area in the upstroke direction is equal to the annular area $A_{ANN}$. The pumping area in the downstroke direction is equal to the rod area $A_R$. The ratio of the upstroke pumping area to the downstroke pumping area is expressed as a ratio in the rightmost column of the table.

FIGS. 16 through 20, in conjunction with the table below, particularly the ratio found in the rightmost column, serve to illustrate three further aspects and alternate embodiments of my invention, as are described with respect to FIGS. 18 through 20 in the text below the table.

As shown in FIG. 16, a pump rod 24*a* of the present invention may be a solid non-corroding metal rod, such as galvanized steel, stainless steel, copper or aluminum. Pump rod 24*a* has a relatively small diameter J, and therefore consumes only a small portion of the total volume in housing 12. As shown in rightmost column of the table, hand pump 10 equipped with pump rod 24*a* will pump a substantial amount of the liquid during its upstroke pumping movement, but only a very little on the downstroke. This is typical of some prior art portable hand pumps on the market.

As shown in FIG. 17, a pump rod 24*b* of the present invention may be a hollow cylindrical-shaped non-corroding metal tube with a larger diameter K. Pump rod 24*b* realizes an up/down ratio of about 1.86, in contrast to a ratio of about 18 for rod 24*a*. Accordingly, a greater portion of the pumping capacity is performed during the upstroke movement with pump rod 24*b*. Some portable prior art hand pumps have all-plastic pump rods with this kind of rod to bore area ratio.

FIG. 18 shows a first ergonomically designed embodiment for the hand pump of the present invention. The portable hand pump illustrated in FIG. 18 is representative of those hand pumps whose pump rods have diameters such that their rod area $A_R$ is about equal to (within plus or minus ten percent of) the annular area $A_{ANN}$ which exists between the rod and the internal bore of the housing 12. Pump rod 24*c* is a hollow, sealed tube made of non-corrosive non-metallic material such as polyvinyl chloride (PVC) plastic which has a diameter L still larger than diameter J. Preferably, the annular area is equal to the rod area so that there is an up/down ratio of unity. This enables a user to pump liquid in substantially equal portions during upstroke and downstroke pumping movements. For smaller portable hand pumps of the present invention, such as those having internal diameters 13 within housing 12 that are about 1.5 inches in diameter or less, this construction is preferred. This is because it is easy for an average adult or older teenager, even those who are not strong, to move the pump rod back and forth, particularly when the pumping action equally divided between the upstroke and downstroke of the pump rod, so that the muscles of the arms and upper body are not taxed excessively in either direction.

FIG. 19 shows a second ergonomic portable hand pump of the present invention. Its hollow pump rod 24*d* with a diameter M is larger still than rod diameter L in FIG. 18. As shown in the above table, rod 24*d* realizes an upstroke/

| | | Bore | | Rod | | Annulus Area | UpS. Area/ DnS. Area |
|---|---|---|---|---|---|---|---|
| Fig. No. | Illustrates (comment) | Dia. (In.) | Area $A_B$ | Dia. (In.) | Area $A_R$ | $A_{ANN} = (A_B - A_R)$ | Ratio $(= A_{ANN}/A_R)$ |
| 16 | $A_{ANN} >> A_{ROD}$ (Upstroke pumps much more than downstroke) | 2.2 | 3.80 | .500 | 0.20 | 3.60 | 18.00 |
| 17 | $A_{ANN} > A_{ROD}$ (Upstroke pumps more than downstroke) | 2.2 | 3.80 | 1.30 | 1.33 | 2.47 | 1.86 |
| 18 | $A_{ANN} = A_{ROD}$ (Upstroke pumps same volume as downstroke) | 2.2 | 3.80 | 1.555 | 1.90 | 1.90 | 1.00 |
| 19 | $A_{ANN} < A_{ROD}$ (Upstroke pumps less than downstroke) | 2.2 | 3.80 | 1.67 | 2.19 | 1.61 | 0.74 |
| 20 | $A_{ANN} << A_{ROD}$ (Upstroke pumps much less than downstroke) | 2.2 | 3.80 | 1.80 | 2.54 | 1.26 | 0.50 |

downstroke area ratio of 0.74, which means the pump will deliver about one-third more water from the outlet during the downstroke than will it during an upstroke of equal distance. FIG. 19 is thus representative of my hand pumps of the present invention whose pump rods have diameters whose rod area $A_R$ is at least ten percent greater than and up to somewhat less than twice the annular area $A_{ANN}$. In other words, these are pumps having an $A_{ANN}/A_R$ ratio equal to or between 0.6 and about 0.9.

FIG. 20 shows a third ergonomic portable hand pump of my invention, namely a hollow pump rod 24*e* with diameter N that is even larger than diameter M. This FIG. 20 embodiment shows a pump have a rod area $A_R$ that is about twice annular area $A_{ANN}$. As such, it is illustrative of my hand pumps of the present invention, whose pump rods have diameters relative to the housing bore such that the $A_{ANN}/A_R$ ratio is about one-half (0.5) or less. In other words, a pump rod 24 with a diameter larger than that of rod 24*e* could be used to achieve yet a greater pumping capacity on the downstroke.

In these and other embodiments, the pump rod sizes may be varied, just by using different pump rod stock, in order to achieve the desired pumping mechanics. Likewise, a smaller rod may be desired if a user desires to exert less force on the downstroke movement and more force on the upstroke movement.

In operation, the liquid hand pump 10 may have inlet and outlet fittings selected from the assembly kit as shown in FIG. 1 in order to accommodate the specific needs of the user. For instance, the inlet port 16 may include a check valve inlet assembly 28 connected to inlet connector 14 in addition to filters 36 and 40. Alternately, bottom coupler 30 or bottom check valve 32 may be connected to the input port 16 and further connected to hose coupler 42, tubing connector 46 or other extension devices. In any event, the input port 16 preferably includes a check valve that is generally necessary to achieve the proper liquid flow into the inlet port 16, while preventing liquid flow in the opposite direction.

In order to further accommodate the needs of the user, the liquid hand pump 10 may include the attachment of a variety of outlet fittings connected to the outlet port 20. For instance, an outlet coupling 58 or coupling 60 with a shut-off valve may be attached. Alternately, a check valve coupling 62 or combination check valve and shut-off valve coupling 64 may be connected to the output port 20. An output hose coupling 66 or shut-off valve coupling with hose connector 68 may also be selected to be connected to the outlet port 20. The above outlet fittings may further be connected to a garden hose or tubing or other extension devices to accommodate the intended use thereof.

Once the desired inlet and outlet fittings have been selected and attached, a user may proceed to pump liquids from the inlet port 16 out through the outlet port 20. In doing so, a user forcibly reciprocates the pump rod 24 via handle 26 so that the plunger mechanism 80 or 80' moves in upstroke and downstroke movements. Initially, a full downstroke movement and then an upstroke movement may be required in order to prime the pump 10, i.e., fill the pump housing 12 with liquid. Once filled, the plunger mechanism 80 or 80' may be forcibly depressed toward the bottom end of housing 12 through a downstroke movement. When this occurs, the rubber diaphragm 82 of plunger mechanism 80 or 80' flexes so that liquid flows around the rubber diaphragm 82 or 82' and between the internal bore 13 and rubber diaphragm 82 or 82'. This enables the pump mechanism 80 or 80' to travel toward the bottom end of housing 12 through a body of liquid.

During an up stroke movement, the plunger mechanism 80 or 80' sealingly engages the internal bore 13 of housing 12. The rubber diaphragm 82 or 82' therefore pulls the liquid located thereabove up toward the outlet port 20 through which the liquid exit the pump 10. According to one embodiment, pump rod 24 has a relatively small diameter and therefore pumps almost all of the liquids out of pump 10 during the upstroke movement.

In accordance with another embodiment of pump rod 24, rod 24 fills up approximately half of the volume available in the pump housing 12 when fully extended in housing 12. This in effect changes the pump operation so that a user may pump approximately half of the liquids during a downstroke movement and the remaining half during an upstroke movement. This two stroke pumping operation tends to more evenly divide the amount of force that is necessary between the up and down stroke movements.

A larger diameter pump rod 24 could be used to provide a more accommodating ergonomic pump for use in situations where effort is more easily applied in the downward stroke, such as in larger hand pumps, which might be used for example at construction sites to empty large amounts of water from holes, perhaps having an internal diameter between about 2.5 inches and about five inches.

In yet another embodiment best shown in FIGS. 12, 13A and 13B, the plunger mechanism 80' may include the addition of a second rubber diaphragm 120 abutting the first rubber diaphragm 82' and the inclusion of a plurality of openings 128 extending through rubber diaphragm 82'. The second rubber diaphragm 120 in effect operates as a flapper valve by allowing liquid to flow through openings 128 during downstroke movement while sealingly engaging the openings 128 during upstroke movement. Openings 128 therefore provide alternate paths for flow of liquid through the plunger mechanism 80' during downstroke movement, thus significantly reducing downstroke effort.

The hand pump described herein is made from commonly available components that may be disassembled when necessary to allow a user to repair or replace worn components or to clean the housing 12. This can be accomplished with the help of simple tools such as pliers or pipe wrenches, if necessary, but is designed to avoid the need for unusual amount of effort or tools that are not commonly available.

One advantage of the hand pump designs of the present invention is that their seals and plunger members are so simple that they are very low cost to produce. Another advantage is that they can be readily fabricated, if necessary, by a user, by simply cutting any one of a number of widely-available cloth-reinforced rubber sheets into a circular disc using a pair of scissors or tin snips, and then poking the necessary holes through the disc using a hand drill, a leather punch, or a scratch awl or large nail.

Similarly, other components are readily available in local hardwares or plumbing supply stores. Thus, even if almost any part, such as the cylindrical housing 12 or the three-piece connector 18, should break unexpected (perhaps because the pump was abused), a replacement part can almost always be readily be purchased, and the pump restored to operating condition without any major effort or expense. My pump designs are intentionally designed to maximize opportunities for these and other rather easy repairs by the user, thus maximizing the re-use of those pump components still in serviceable condition, and minimizing the need to throw good pump components away into a municipal waste stream just because one or two parts of an otherwise good pump are worn out.

Those skilled in the field will appreciate that the foregoing embodiments of the present invention which have been illustrated and discussed are subject to modification and change without departing from the scope of the invention as recited in the claims below. The size, proportion, thickness of seals or gaskets or tubular housings, the materials, and clearances of the various components used in these hand pumps may be varied. Examples of further possible changes, beyond those already mentioned earlier, include the following: (1) Any suitable handle shape may be utilized. (2) Any suitable interconnection between the pump rod and handle may be employed, including allowing the pump handle to spin or swivel relative to the pump rod if desired by using an appropriately designed coupling. (3) The plunger mechanism may be spinnably coupled to the pump rod if desired, by using a rotatable coupling that still holds the plunger seal member generally in a plane perpendicular to the axis of the pump handle, as shown in the various embodiments of the present invention. (4) If desired, those components which are not expected to normally require replacement due to wear or rough use may be permanently assembled using glue or other suitable adhesive, but preferably at least one way is kept for allowing the repair and replacement of the plunger mechanism. (5) Different features and aspects of one embodiment may be combined with, or replaced by alternate feature from, another embodiment to provide a hand pump have the desired features from both.

Thus, it is to be understood that the present invention is by no means limited to the particular constructions herein disclosed and/or shown in the drawings. Instead, the present invention also encompasses any modifications or equivalents within the scope of the disclosures that are fairly covered by the claims set forth below.

I claim:

1. A versatile hand-portable, hand-operated liquid pump comprising:

an inlet port for receiving liquid into the pump;

an outlet port for discharging liquid from the pump;

a substantially cylindrical housing having an elongated internal bore and a bottom end in fluid communication with the inlet port and a top end in fluid communication with the outlet port;

an elongated pump rod having a lower end and an upper end connectable to a handle for enabling a user to manually reciprocate the rod in an upstroke movement and a downstroke movement within the bore of the housing;

a plunger pump assembly connected to the lower end of the pump rod and having a plunger mounted in the housing for slidingly engaging the bore of the housing during upstroke and downstroke movements within the bore of the housing;

an inlet fitting, forming the inlet port, removably coupled to the bottom end of the housing for receiving an inlet attachment, wherein the pump rod has a length sufficiently long so that the plunger assembly may be extended beyond the bottom end of the housing when the inlet fitting is removed to allow access to the plunger for service;

a unidirectional flow device operatively connected to the inlet fitting for allowing liquid to flow in a direction from the inlet port toward the outlet port while substantially preventing liquid from flowing in the opposite direction; and a three-way connector structure including a substantially sealed end and having a first passage engaged with the top end of the cylindrical housing and a second passage forming the outlet port and a third passage connected to the substantially sealed end which has a hole extending therethrough for substantially engaging the pump rod, the pump rod extending through the hole and the first and third passages.

2. The pump as defined in claim 1 further comprising an inlet attachment connected to and in fluid communication with the inlet fitting, the inlet attachment selected from the group consisting of: (1) an elbow connector for providing a right-angle extension, (2) an inlet assembly having at least one opening and a filter for receiving the inlet liquid through the opening, and (3) a hose adapter having a connector for engaging a hose to allow connection to the inlet port via the hose.

3. The pump as defined in claim 1 further comprising an exhaust attachment connected to and in fluid communication with the outlet port selected from the group consisting of: (1) a hose adapter-having a connector for engaging a hose to allow for the outlet port to extend through the hose, (2) an outlet assembly having a unidirectional check valve for preventing fluid flow in a direction from the outlet port into the housing, and (3) an outlet assembly having a manually-operated shut off valve for preventing fluid flow therethrough when manually selected to a closed position.

4. The pump as defined in claim 1 wherein the substantially sealed end is the top end of the pump and includes a cap fitting having the hole passing therethrough normally sealingly connected to the third passage of the three-way connector.

5. The pump as defined in claim 1 wherein the plunger comprises a flexible resilient diaphragm for sealingly engaging the internal bore of the cylindrical housing during an upstroke movement and flexing to allow liquid to pass between the internal bore of the housing and the resilient diaphragm during a downstroke movement.

6. The pump as defined in claim 1 wherein the plunger pump assembly comprises a first flexible resilient diaphragm for slidingly engaging the internal bore of the housing during upstroke movement and having at least one passage formed therein for liquid to pass therethrough, and a second resilient diaphragm abutting the first resilient diaphragm and sealingly engaging the passage during the upstroke movement and allowing liquid to flow through the passage during downstroke movement.

7. The pump as defined in claim 1 further comprising a cup member connected to the pump rod above the plunger for relieving a portion of dynamic forces on the plunger during upstroke movement.

8. The pump as defined in claim 1 wherein the plunger pump assembly is removable from the housing to provide ease of repairability.

9. The pump as defined in claim 8 wherein at least a part of the three-way connector structure of the pump is removable to enable a user to remove the plunger pump assembly from the housing.

10. A hand-operated liquid pump that offers enhanced repairability comprising:

a housing structure having an elongated internal bore and a bottom end forming an inlet port and a top end in fluid communication with an outlet port located near the top end;

a plunger pump assembly having a plunger mounted in the internal bore of the housing for manual reciprocation within the internal bore;

a pump rod structure having a handle and a pump rod connected to the plunger pump assembly for enabling a user to manually reciprocate the plunger in upstroke and downstroke movements within the internal bore of the housing, the pump rod having a length sufficiently long so that the plunger may be extended beyond the bottom end of the housing to allow easy access for repairs;

a unidirectional check valve in fluid communication with the bottom end of the housing for allowing liquid to flow in a direction from the inlet port towards the outlet port while substantially preventing liquid flow in the opposite direction; and a manually removable inlet assembly attached to the inlet port for receiving the liquid and which is readily removable by a user to access the plunger for repair.

11. The pump as defined in claim 10 wherein the housing structure includes an elongated cylindrical section in which the internal bore is located, and a three-way connector section having a first passage engaged with first end of the cylinder and a second passage forming the outlet port and a third passage connected to a substantially sealed end and having a hole extending therethrough for engaging the pump rod, and the pump rod extending through the hole and the first and third passages.

12. The pump as defined in claim 10 further comprising an outlet assembly attached to the outlet port for selectively controlling flow of liquid out of the outlet port.

13. The pump as defined in claim 10 further comprising a filter operatively coupled to the inlet port for filtering unwanted particles from the liquid prior to its entry into the housing structure.

14. The pump as defined in claim 10 wherein the plunger comprises a flexible bendable diaphragm for sealingly engaging the internal bore of the housing structure during an upstroke movement and flexing to allow liquid to pass between the internal bore of the housing and the diaphragm during a downstroke movement.

15. The pump as defined in claim 10 wherein the plunger comprises a first resilient member and having a plurality of passages formed therein for permitting liquid to flow therethrough for slidingly engaging the internal bore of the housing during upstroke movement and a second member abutting the first resilient member for substantially sealingly engaging the passages during the upstroke movement and for allowing liquids to flow through the passages during downstroke movement.

16. The pump as defined in claim 10 further comprising a cupped member connected to the pump rod above the plunger for relieving a portion of liquid flow pressure applied to the plunger during upstroke movement.

17. A hand-operated liquid pump having a resilient plunger and which offers easy manual access to the plunger for user repairs in the field, comprising:

a housing having an elongated internal bore and a bottom end forming an inlet port and a top end with an outlet port located near the top end;

a plunger pump assembly having a plunger that is mounted in the bore of the housing that may be manually reciprocated within the internal bore of the housing;

a pump rod having a handle and connected to the plunger pump assembly for enabling a user to manually reciprocate the plunger in upstroke and downstroke movements within the internal bore of the housing, wherein the pump rod has a length sufficiently long so that the plunger may be extended beyond the bottom end of the housing to allow easy access for repairs;

a unidirectional check valve connected to the bottom end of the housing for allowing liquids to flow in a direction from the inlet port towards the outlet port while preventing liquid flow in the opposite direction;

a three-way connector having a first passage engaged with the first end of the cylinder and a second passage forming the outlet port and a third passage, the rod normally extending through the first and third passages during operation of the pump;

a removable cap structure connected to the third passage for allowing a user to remove the plunger pump assembly from the housing through the third passage;

at least one inlet attachment connectable to the inlet port which is hand-removable and hand-reinstallable repetitively relative to the inlet port as desired, the one inlet attachment being selected from the group consisting of:

(1) an elbow connector for providing a right-angle extension, (2) an inlet assembly having at least one opening and an structural portion for helping filter at least coarse aggregate material from liquid passing through the opening, and (3) an adapter having a connector for engaging a hose or tube to allow connection to the inlet port via the hose or tube; and (4) and extension adapter for receiving a rigid cylindrical member; and at least one exhaust attachment connectable to the outlet port which is hand-removable and hand-reinstallable repetitively relative to the outlet port as desired, the exhaust attachment selected from the group consisting of:

(1) a hose adapter having a connector for engaging a hose to allow for the outlet port to extend through the hose, (2) an outlet assembly having a uni-directional check valve for preventing fluid flow in a direction from the outlet port into the housing, (3) an outlet assembly having a manually-operated shutoff valve for preventing fluid flow therethrough when manually selected to a closed position, and (4) and extension adapter for receiving a rigid cylindrical member.

18. The pump as defined in claim 17 further comprising a filter operatively coupled to the inlet port for filtering unwanted particles from the liquids.

19. The pump as defined in claim 17 wherein the plunger comprises a rubber diaphragm for sealingly engaging the internal bore of the cylindrical housing during an upstroke movement and flexing to allow liquids to pass between the housing and rubber diaphragm during a downstroke movement.

20. The pump as defined in claim 17 wherein the plunger comprises a first rubber diaphragm having at least one passage formed therein for slidingly engaging the internal bore of the housing during upstroke movement in the housing and a second diaphragm abutting the first rubber diaphragm and sealingly engaging the passage during the upstroke movement and allowing liquids to flow through the passage during downstroke movement.

21. The pump as defined in claim 17 further comprising a cup member connected to the pump rod above the plunger for relieving a portion of liquid flow pressure applied to the plunger during upstroke movement.

22. A hand-portable liquid pump operated by back and forth hand reciprocation of a pump rod concentrically extending into a pump housing, the pump comprising:

a substantially cylindrical housing having an elongated internal bore and a bottom end forming an inlet port and a top end with an outlet port located near the top end;

a plunger mounted in the housing for slidingly engaging the internal bore of the housing during upstroke movement in the housing and allowing liquid to flow between the plunger and the internal bore during downstroke movement;

a pump rod connected to the plunger and having a cross-sectional area equal to substantially half the cross-sectional area of the internal bore of the cylindrical housing;

a unidirectional check valve connected to the bottom end of the housing for allowing liquids to flow in a direction from the inlet port towards the outlet port while preventing liquid flow in the opposite direction;

an inlet assembly attached to the bottom end of the housing for receiving the liquids;

a three way connector having a first passage engaging the top end of the cylindrical housing and a second passage forming the outlet port and a third passage connected to a sealed fitting which has a hole formed therein for sealingly engaging the pump rod, and the pump rod extending through the hole and the first and third passages;

an exhaust assembly attached to the outlet port for directing the liquids out of the outlet port; and a handle connected to the pump rod for enabling a user to manually reciprocate the plunger and pump rod within the internal bore of the housing so that liquids may be pumped out the outlet port during both upstroke and downstroke movement.

23. The pump as defined in claim 22 further comprising a filter operatively coupled to the inlet port for filtering unwanted particles from the liquids.

24. The pump as defined in claim 22 wherein the plunger comprises a rubber diaphragm for sealingly engaging the internal bore of the cylindrical housing during an upstroke movement and flexing to allow liquids to pass between the bore of the housing and rubber diaphragm during a downstroke movement.

25. The pump as defined in claim 22 wherein the plunger comprises a first rubber diaphragm having at least one passage formed therein for slidingly engaging the internal bore of the housing during upstroke movement and a second diaphragm abutting the first rubber diaphragm and sealingly engaging the passage during the upstroke movement and allowing liquids to flow through the passage during downstroke movement.

26. The pump as defined in claim 22 further comprising a sleeve member connected to the pump rod above the plunger for relieving a portion of liquid flow pressure applied to the plunger during upstroke movement.

27. A hand-operated liquid pump comprising:

a substantially cylindrical housing having an elongated internal bore and a bottom end forming an inlet port and a top end with an outlet port located near the top end;

a plunger mounted in the internal bore of the housing and having a first rubber diaphragm having at least one passage formed therein for slidingly engaging the internal bore of the housing during upstroke movement and a second diaphragm abutting the first rubber diaphragm and sealingly engaging the passage during the upstroke movement and allowing liquids to flow through the passage during a downstroke movement;

a unidirectional check valve connected to the bottom end of the housing for allowing liquids to flow in a direction from the inlet port towards the outlet port while preventing liquid flow in the opposite direction;

a pump rod connected to the plunger and a handle for enabling a user to manually move the plunger in the upstroke and downstroke movement, wherein the pump rod has a cross-sectional area so as to achieve more pumping capacity during the downstroke movement of the plunger than the upstroke movement of the plunger; and an enlarged sleeve member coupled to the pump rod above the plunger for moving a portion of the liquids toward the outlet port so as to relieve a portion of pressure applied to the plunger during upstroke movement.

28. The pump as defined in claim 27 wherein the enlarged sleeve member comprises a concave top portion for engaging liquids during upstroke motion and an inclined bottom for enhancing aerodynamics during the downstroke movement.

29. A versatile hand-portable, hand-operable liquid pumping kit in pieces ready for assembly by a user, comprising:

an assembled hand-operated liquid pump having a housing with an elongated internal bore and a plunger connected to an elongated pump rod and handle for slidingly engaging the internal bore of the housing during upstroke movement and downstroke movement, the pump further having an inlet port for receiving liquid into the pump and an outlet port for discharging liquid from the pump, and a unidirectional flow device, operatively associated with the inlet port, for at least substantially ensuring liquid flow in only one direction through the inlet port, wherein the pump rod has a cross-sectional area so as to achieve more pumping capacity during the downstroke movement of the plunger than during the upstroke movement of the plunger;

at least one inlet attachment connectable to the inlet port which is hand-removable and hand-reinstallable repetitively relative to the inlet port as desired, the one inlet attachment being selected from the group consisting of:

(1) an elbow connector for providing a right-angle extension, (2) an inlet assembly having at least one opening and an structural portion for helping filter at least coarse aggregate material from liquid passing through the opening, and (3) an adapter having a connector for engaging a hose or tube to allow connection to the inlet port via the hose or tube; and (4) and extension adapter for receiving a rigid cylindrical member; and at least one exhaust attachment connectable to the outlet port which is hand-removable and hand-reinstallable repetitively relative to the outlet port as desired, the exhaust attachment selected from the group consisting of:

(1) a hose adapter having a connector for engaging a hose to allow for the outlet port to extend through the hose, (2) an outlet assembly having a uni-directional check valve for preventing fluid flow in a direction from the outlet port into the housing, (3) an outlet assembly having a manually-operated shutoff valve for preventing fluid flow therethrough when manually selected to a closed position, and (4) and extension adapter for receiving a rigid cylindrical member.

30. A hand-portable, hand-operated liquid pump field-repairable by a user, comprising:

a housing having an elongated internal bore and a first end forming an inlet port and a second end with an outlet port located near the top end;

a plunger pump assembly having a plunger that is mounted in the internal bore of the housing that may be manually reciprocated within the internal bore of the housing;

a pump rod having a handle and connected to the plunger pump assembly for enabling a user to manually reciprocate the plunger in upstroke and downstroke movements within the internal bore of the housing;

a uni-directional flow device connected to the bottom end of the housing for allowing liquids to flow in a direction from the inlet port towards the outlet port while substantially preventing liquid from flowing in the opposite direction;

wherein the pump rod has a cross-sectional area which occupies at least one-half of the cross-sectional area of the internal bore of the housing.

31. A hand-portable, hand-operated liquid pump comprising:

a housing having an elongated internal bore and a bottom end forming an inlet port and a top end with an outlet port located near the top end;

a plunger pump assembly having a plunger that is mounted in the internal bore of the housing that may be manually reciprocated within the internal bore of the housing;

a pump rod having a handle and connected to the plunger pump assembly for enabling a user to manually reciprocate the plunger in upstroke and downstroke movements within the internal bore of the housing; and a uni-directional check valve connected to the bottom end of the housing for allowing liquids to flow in a direction from the inlet port towards the outlet port while preventing liquid flow in the opposite direction, wherein the pump rod has a cross-sectional area consumes a sufficient cross-sectional area of the internal bore of the housing so as to achieve at least one-third more pumping capacity during the downstroke movement of the plunger than during the upstroke movement of the plunger.

32. The pump of claim 31, further comprising a manually removable inlet structure and a plunger assembly which includes at least one pliable sealing member for slidably engaging the internal bore, the plunger assembly being adapted for manual disassembly to enable the sealing member to be replaced in the field by a user having no more than simple hand tools available for such repair work.

33. The pump as defined in claim 31 wherein the pump rod has a cross-sectional area so as to achieve at least twice the pumping capacity during the downstroke movement of the plunger than during the upstroke movement of the plunger.

* * * * *